United States Patent [19]

Drapeau

[11] 4,322,701

[45] Mar. 30, 1982

[54] MAGNETIC CIRCUIT FOR MINIATURE RELAYS

[75] Inventor: Donald F. Drapeau, Windsor, Conn.

[73] Assignee: Hi-G Incorporated, Windsor Locks, Conn.

[21] Appl. No.: 143,454

[22] Filed: Apr. 24, 1980

[51] Int. Cl.[3] ..... H01H 50/02; H01H 50/16

[52] U.S. Cl. ..... 335/202; 335/278

[58] Field of Search ..... 335/202, 203, 278, 128, 335/124, 162

[56] References Cited

U.S. PATENT DOCUMENTS 3,255,327 6/1966 Wood, Jr. ..... 335/124

4,101,855 7/1978 Drapeau ..... 335/203

*Primary Examiner*—Harold Broome

*Attorney, Agent, or Firm*—Hayes & Reinsmith

[57] ABSTRACT

A magnetic circuit for a miniature relay comprising a coil carried by a magnetic frame and an armature adapted for movement in response to energization of the coil to close an air gap between the armature and a pole face of the frame. A portion of the frame comprising a pair of supporting legs is sufficiently close to a core face portion of the frame to define a fringing flux path tending to divert flux from the useful flux path including the armature, air gap and frame. A barrier is provided in the fringing flux path of a material creating sufficient reluctance in that path to resist flux flow therethrough thereby increasing flux flow in the useful flux path to increase relay efficiency. The barrier can comprise non-magnetic material in the supporting legs, in the core face or in both. A method of making the frame includes forming a bi-metal strip including a center magnetic iron section and two side non-magnetic stainless steel sections welded thereto and then forming the desired frame configuration and shape by stamping and bending.

16 Claims, 8 Drawing Figures

208
192
190
214
198
220
202
194
178
174
164
162
176
206
200
182
180
160
168
210
224
172
184
166
170

100
104
114'
106
102
144
142
146
150
6
148
140

146
150
142
148
144
140

230
232
234
244
270
246
250
282
294
272
280
208'
248
284
254
206'
274'
252
288
286
224
236
290
260
264
262
292
240
242

MAGNETIC CIRCUIT FOR MINIATURE RELAYS

BACKGROUND OF THE INVENTION

This invention relates to a relay structure and more particularly to an improved magnetic circuit for miniature relays.

Miniature electromagnetic relays are in constant demand as a result of the advanced degree of miniaturization which has developed in the electronics arts. There is need to provide a miniature relay having a magnetic circuit which maximizes the amount of magnetic flux doing useful work in operating the relay thereby increasing its efficiency. This must be accomplished in a manner which provides a miniature relay of low cost which is easy to fabricate and assemble.

SUMMARY OF THE INVENTION

The principal object of this invention is to provide an improved magnetic circuit for a miniature relay.

It is a further object of this invention to provide an improved magnetic circuit for a miniature relay which maximizes the amount of magnetic flux doing useful work in operating the relay.

It is a further object of this invention to provide an improved magnetic circuit for a miniature relay which is easy and economical to manufacture.

It is a further object of this invention to provide a method for making a magnetic frame for use in an improved magnetic circuit for a miniature relay.

The present invention provides a magnetic circuit for a miniature relay comprising a coil carried by a magnetic frame having a core portion terminating in a core face and a pole piece portion terminating in a pole face, and an armature having a portion spaced a small distance from the pole face defining an air gap therebetween when the coil is de-energized, the armature being adapted for movement in response to energization of the coil to close the air gap. The armature has a portion adjacent the core face, and the relay magnetic circuit includes a useful flux path through the core portion, the pole piece portion, the air gap between the pole face and the armature, the armature and the core face. The magnetic frame has another portion located sufficiently close to the core face to define a fringing flux path through the other frame portion and core face tending to divert flux from the useful flux path. A barrier is provided in the fringing flux path of a material, for example non-magnetic material, which causes the fringing flux path to have sufficient reluctance to resist the flow of flux through the fringing flux path thereby increasing the flow of flux through the useful flux path. A method of making the frame includes welding, rolling and stamping a bi-metal structure to provide magnetic and non-magnetic frame sections.

The invention accordingly consists in the features of construction, combination of elements and arrangement of parts which will be exemplified in the construction hereafter set forth and the scope of the application which will be indicated in the appended claims.

BRIEF DESCRIPTION OF THE DRAWING FIGURES

DETAILED DESCRIPTION OF THE ILLUSTRATED EMBODIMENTS

Figure 2:
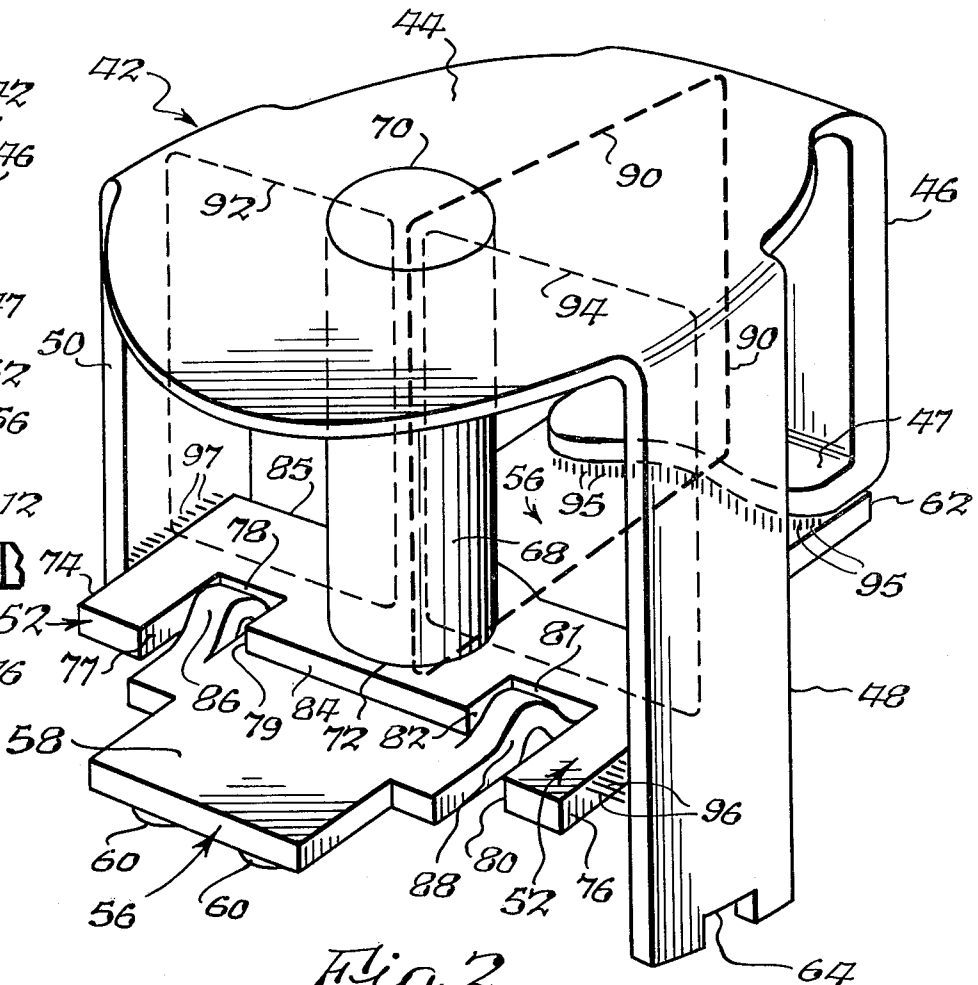
FIG. 2 is a perspective view of the magnetic frame and armature assembly defining the magnetic circuit of the relay of FIG. 1 and showing the useful and fringing flux paths.

In basic miniature relay structures a coil is carried by a frame of magnetic material having a core portion extending longitudinally through and beyond the coil and terminating in a core face and a pole piece portion terminating in a pole face. An armature has a portion spaced a small distance from the pole face defining an air gap therebetween when the coil is de-energized, and the armature is adapted for movement in response to energization of the coil to close the gap. The armature has a portion adjacent the core face, and the relay magnetic circuit includes a useful flux path through the core portion, the pole piece portion, the air gap between the pole face and the armature, the armature and the core face. The magnetic frame has another portion located sufficiently close to the core face to define a fringing flux path through the other frame portion and core face tending to divert flux from the useful flux path. For example, such other frame portion can comprise a pair of spaced-apart legs of magnetic material extending from one end of the frame outwardly of and along the coil and terminating near the core face.

In accordance with this invention a barrier is provided in the fringing flux path of a material, for example non-magnetic material, which causes the fringing flux path to have sufficient reluctance to resist the flow of flux through the fringing flux path thereby increasing the flow of flux through the useful flux path to increase the efficiency of the relay. The barrier can be located in the other portion of the frame, in the core face portion or in both. For example, the barrier can comprise non-magnetic material along a major portion, preferably the entire portion, of the length of each of the frame leg portions. In addition, non-magnetic material can be provided in the core face to an extent and in a location which is not in the region of the useful flux path. A method of making a magnetic frame according to the present invention includes forming a bi-metal strip by providing a center magnetic iron section and two side non-magnetic stainless steel sections, welding the sections together to form a composite flat strip, and forming the desired frame configuration and shape by suitable operations such as stamping and bending.

Referring to the drawings, a typical miniature relay 10 comprises several principal assemblies or elements including a motor assembly which comprises a coil mounted between a magnetic frame and a support, an armature assembly, and a header assembly which contains switch contact elements and terminal pins on a supporting base.

In the relay structure shown, the header 16 is formed of metal having a platform surface 18 of generally circular configuration with the header serving as a supporting base for the components. A peripheral flange 19 cooperates with the lower flange portion of a casing or cover 20 which is suitably attached to the header by soldering or welding after assembly of the components thereby hermetically sealing the relay structure. A plurality of current carrying terminal pins 24 project through apertures provided in header 16. The pins 24 are secured by elements of fused glass or the like, one shown at 26 in FIG. 1, which also provides both electrical insulation and a fluid-tight seal between header 16 and each pin 24. At least some of the terminal pins extend through and beyond the surface 18 of header 16.

Figure 1:
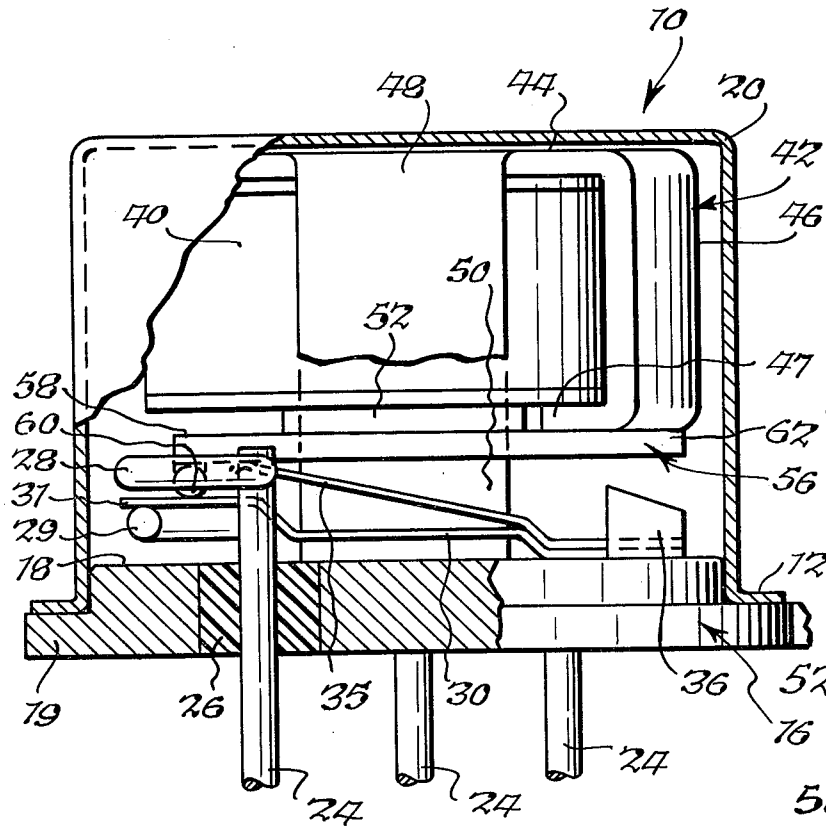
FIG. 1 is an elevational view of a typical miniature relay.

The contact assembly includes a first stationary contact 28 joined to the end of a terminal pin 24 as shown in FIG. 1. Contact 28 extends in a direction generally into the plane of the paper as viewed in FIG. 1 adjacent the extended portion of another terminal pin (not shown) directly behind pin 24 as viewed in FIG. 1. A second stationary contact 29 is joined to the extended portion of this rearward terminal pin extension and the contact 29 extends to a location adjacent the forward terminal pin as viewed in FIG. 1. The free ends of the contacts 28,29 are overlapped and spaced apart in a direction normal to the header surface 18. By way of illustration, each of the stationary contacts 28 and 29 can comprise an arcuate wire having substantially the same radius and center of curvature. A movable contact member or switch blade 30 is mounted on the header 16 and is electrically connected to one of the terminal pins 24. This can be done, for example, by mounting the moving contact 30 directly on the electrically conductive header 16 and joining the terminal pin, for example, the middle one as viewed in FIG. 1, directly to the header without any electrical insulation. The moving contact 30 has a free end 31 extending between the free ends of the stationary contacts 28 and 29. In the relay shown, movable contact 30 normally is biased into engagement with the upper stationary contact 28 when the relay is not energized. The header assembly further includes a return spring 35 mounted on the header 16 for separating the relay armature from the movable contact 30 by moving the armature into the retracted position when the relay is to be energized. A stop member 36 is mounted on the surface 18 of header 16 and positioned to brace the relay armature in its retracted position.

The motor assembly includes a wire coil 40 wound on a bobbin of insulative material and is positioned in the relay structure with the longitudinal axis of the coil substantially perpendicular to the header surface 18. The coil is connected electrically to the terminal pins by electrical conductors or ribbon-like leads, one of which is designated 42 in FIG. 1. Thus, current is delivered through conductors from the terminal pins to excite the winding 40 and operate the relay. Coil 40 is supported by a magnetic frame 42 including an end portion 44, a pole portion 46 operatively associated with coil 40, and an inwardly extending portion or frame pad 47 which defines a first magnetic pole face. The frame also include two spaced-apart parallel legs 48,50 depending from end portion 44 and extending in the same direction at substantially right angles to the end portion 44. Each of the two legs is received in a socket in the support header 16.

A magnetic core (not shown in FIG. 1) extends through the central aperture of the coil 40 and is joined at its upper end as viewed in FIG. 1 to the frame end 44. The core forms a second magnetic pole face at its lower end which is spaced from the first magnetic pole face defined by frame pad 47. A core face element 52 generally in the form of a plate is secured to the lower end of the magnetic core and defines a core face which extends in spaced, substantially parallel relation to the surface 18 of header 16.

An armature 56 is located in spaced relation to header 16 and is in the form of a plate-like body of ferro-magnetic material having a first portion or end tab 58 provided with at least one operator element 60 of insulative material for operatively engaging the end portion 31 of the movable switch contact 30. Movement of armature 56 is guided by a pair of projections which extend into recesses formed in core face 52 under the influence of biasing spring 35 in a manner which will be described. The opposite end of armature 56 has a curved, arcuate edge 62 of substantially the same curvature as the pole piece 46. When the relay is energized, the armature 56 is in the position shown in FIG. 1. When the relay is de-energized the portion of armature 56 adjacent the edge 62 is spaced a small distance from the pole face 46 to define an air gap. In the de-energized condition of the relay, the movable contact 30 is preloaded against the normally closed stationary contact 28 and the armature 56 is biased against the stop 36 by the return spring 35. Therefore, the electrical path in this position is from the normally-closed stationary contact 28 through the movable contact 30. In this condition, the circuit including the normally-open contact 29 is electrically inoperative.

With the application of electrical power through the appropriate pins 24 and coil leads to coil 40, the coil is energized causing armature 56 to be magnetically attracted to frame 42. This magnetic force overcomes the biasing force of the spring and the preloading of the movable contact 30 and causes armature 56 through the operator element 60 to move the switch blade 30 from the normally-closed contact 28 into engagement with the normally-open contact 29. In this position, an electrical signal can be transmitted from the normally-open contact 29 through the movable contact 30. During this operation armature 56 moves about an axis generally perpendicular to the longitudinal axis of the coil 40 and its core. After a small degree of angular movement the armature 56 comes to rest with the upper surface adjacent edge 62 contacting the pole face 47. In the foregoing position, the electrical circuit including the normally closed contact 28 is inoperative. When the electrical potential to coil 40 is removed, armature 56 loses magnetic attraction to frame 42 and is moved to the initial rest position by action of the spring 35 and the resiliency of the switch blade 30. For a more detailed description of the structure and operation of relay 10, reference may be made to U.S. Pat. No. 3,255,327 issued June 7, 1966 the disclosure of which is hereby incorporated by reference.

FIG. 2 illustrates the magnetic frame and armature assemblies in further detail. The end 44 of frame 42 is generally circular in shape, the pole portion 46 is generally arcuate in cross-section and terminates in the inwardly extending frame pad portion 47 to define a pole face. Legs 48,50 are elongated rectangular in shape and provided with notches at the lower ends thereof, for example notch 64 in leg 48, which fit into sockets in the header assembly 18. The magnetic core is in the form of a cylinder 68 having a first end 70 secured to the central portion of the frame end 44 and an opposite end 72 disposed substantially in the same plane as the pole face 47. The core face element 52 is generally rectangular in shape having a central portion of reduced width to which the core end 72 is secured. Core face element 52 has opposite end faces 74 and 76 spaced small distances from the inner surfaces of legs 50 and 48, respectively. A pair of notches or recesses separate the central portion of core face elements 52 from the outer portions adjacent the end faces 74,76. In particular, a first notch or recess is defined by a surface 77 near and parallel to end face 74, an inwardly extending surface 78 parallel to the longitudinal axis of element 52 and a surface 79 in spaced parallel relation to surface 77. Similarly, a second notch or recess adjacent the opposite end of core face 52 is defined by a surface 80 parallel to end face 76, an inwardly extending surface 81 parallel to the longitudinal axis of core face 52 and a surface 82 in spaced parallel relation to surface 80. The central portion is partially bounded by a longitudinal edge 84 extending between notch edges 79,82. Core face 52 has another longitudinal edge 85. Armature 56 comprises an elongated plate of ferromagnetic material and is located below the core face 52 and frame pad 47. The armature 56 is shaped or formed to have a pair of projections or extensions 86 and 88 which are of a size and at a location to be received in the two recesses or slots in core face element 52. In particular, the formations 86,88 are of arcuate, substantially semicircular shape having a length approximately equal to the length of the corresponding edge 79,82 and a width slightly less than the length of the corresponding edge 78,81. The formations 86,88 extend out from the surface of armature 56 a distance which is not significantly greater than the thickness of core face 52.

During operation of the relay, when the coil is energized, all of the magnetic flux in the relay is generated at the core 68, is distributed from the core throughout the relay, and returns to the core through a closed loop path. It would be desirable to turn all of the magnetic flux generated at core 68 into useful work in operating the relay. However, this is not possible because some losses occur, for example due to fringing friction and other causes, thereby determining the efficiency of the system. The useful magnetic flux is designated by the broken line path 90 in FIG. 2. The magnetic flux loss due to fringing is designated by the two paths 92 and 94. In particular, the useful magnetic flux represented by path 90 begins at the core 68, travels through and along the frame end 44 and the pole piece 46 to the frame pad 47, through an air gap 95 to the armature end adjacent edge 62, along the armature 56 to the core face element 52, through the core face 52, and back into the core 68. As the magnetic flux travels through the air gap 95 between the frame pad 47 and the armature 56, useful work is created by the magnetic attraction of the armature to the pad.

It would be desirable to have all of the magnetic flux generated in core 68 follow this useful flux path 90. However, some of the magnetic flux strays away or is diverted from the path 90 and instead travels along the paths designated 92,94. This is because a portion of the magnetic frame 42, i.e. the legs 48,50, is located sufficiently close to the core face 52 to define a fringing, undesired flux path through the other frame portion and core face. In particular, some of the flux travels through the frame end 44 in opposite directions perpendicular to flux path 90, along the frame legs 48,50, through air gaps 96 and 97 between the legs 48 and 50, respectively, and the core face 52, along the core face 52 and back into the core. Since the air gaps 96,97 between core face 52 and the frame legs 48,50 are quite small, a great deal of magnetic flux can travel through the fringe paths 92,94 in the relay shown. Since none of this magnetic flux travels through the armature 56 or appears at the air gap between the armature and frame pad 47, it cannot do any useful work in the relay and accordingly is wasted or fringing magnetic flux.

In accordance with the present invention, if the reluctance in the paths 92,94 can be made sufficiently large, the flow of magnetic flux through these paths will be resisted and as a result less magnetic flux will flow through these paths. In particular, increasing the air gap between the core face 52 and each of the frame legs 48,50 can result in an increase in the reluctance of these paths sufficient to resist the flow of flux therethrough. Then the flux which does not flow through the paths 92,94 will travel through the useful flux path 90 and can be turned into useful work. Magnetic flux lost to fringing will, in this manner, be turned into useful magnetic flux and the relay accordingly will be more efficient.

The foregoing is accomplished, in accordance with the present invention, by providing a barrier in the fringing flux path of a material causing the fringing flux path to have sufficient reluctance to resist the flow of flux therethrough. In particular, a barrier to the fringing magnetic flux is included in each of the paths 92,94. This, in turn, greatly increases the gap between the core face 52 and the magnetic portions of the frame legs. A reluctance to magnetic flux flow in the paths 92,94 is set up and the fringing or wasted magnetic flux is directed in the direction of the useful flux path 90 thereby making the relay more efficient.

Figure 3:
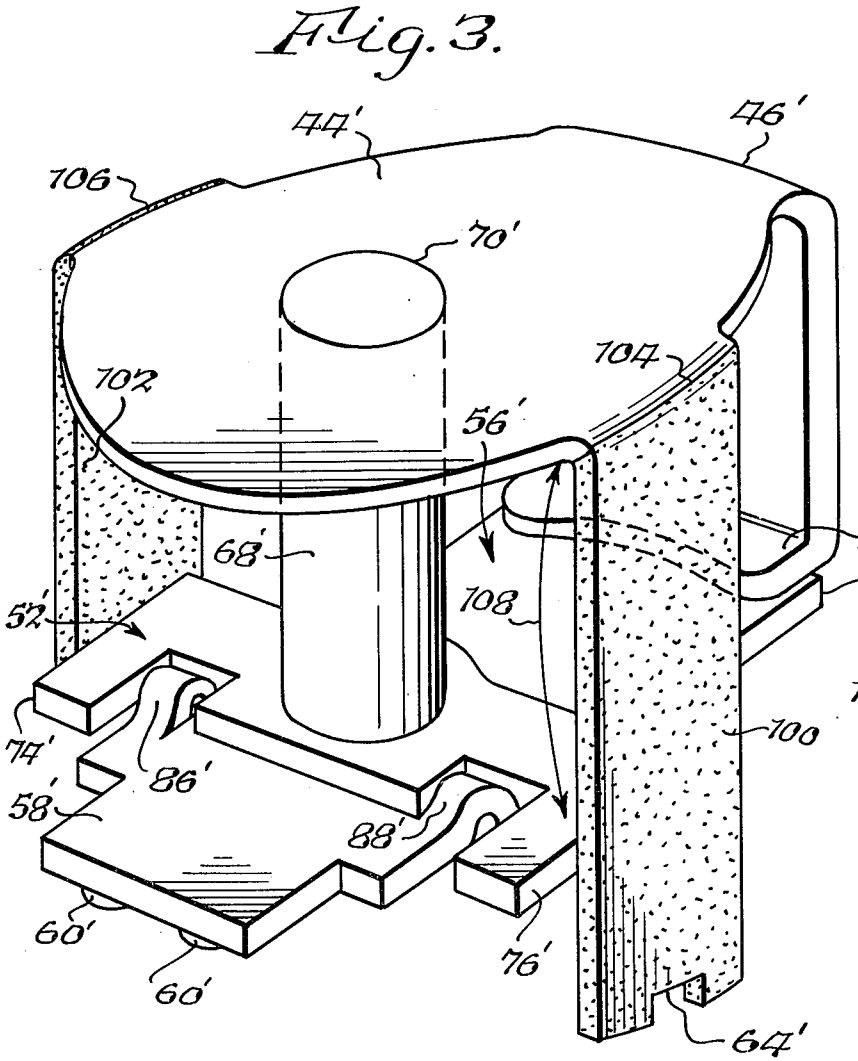
FIG. 3 is a perspective view of a magnetic frame and armature assembly providing an improved magnetic circuit according to the present invention for use in the relay of FIG. 1.

In accordance with the present invention, a barrier of non-magnetic material is provided in the fringing flux path of the relay frame. Referring now to FIG. 3, there is shown a magnetic frame according to the present invention wherein parts similar to the frame of FIG. 2 are provided with identical reference numerals having a prime designation. The frame shown in FIG. 3 has depending legs 100 and 102 which are of non-magnetic material indicated by the stipling in FIG. 3. By way of example, the legs 100,102 are of non-magnetic stainless steel and the remainder of the frame is of magnetic iron. The legs 100 and 102 meet the frame end portion 44 at junctions or seams 104,106, respectively. The manner in which the non-magnetic legs 100,102 are joined to the magnetic frame end in a bi-metal frame structure will be described in detail presently. Each of the non-magnetic legs 100,102 provides a barrier which increases the reluctance of the corresponding fringing flux paths 92,94 shown in FIG. 2. thereby providing increased relay efficiency. The length of the air gap which the fringe flux must traverse is greatly increased, being designated by the line 108 in FIG. 3 extending from the inner or lower surface of frame portion 44' to the upper or inner surface of the core face 52'. This is in contrast to the relatively small gap 96 in fringe flux path 94 shown in FIG. 2 between leg 48 and core face 52. A similar increased path length extends between core face 52' and frame end 44' near leg 102 and is substantially greater than the small air gap 97 shown in FIG. 2.

With the legs 100,102 being of non-magnetic material, the magnetic flux is directed along the useful flux path, for example path 90 shown in FIG. 2, to the frame pad 47' and adjacent air gap where useful work is being done thereby making the relay more efficient. The non-magnetic material in the legs 100,102 cannot be extended too far into the area of the frame end 44' or it will be disposed in the region of the useful flux path thereby blocking the same. This would reduce the efficiency of the relay. Alternatively, the non-magnetic material could occupy less than the entire length of each of the depending legs of the frame. It is preferred that the non-magnetic material comprise a major portion of the length of each of the legs. By way of example, the non-magnetic material could extend from the lower ends of each of the legs along a distance approximately two-thirds to three-quarters of the length of each leg in a direction toward the frame end 44'.

Figure 4:
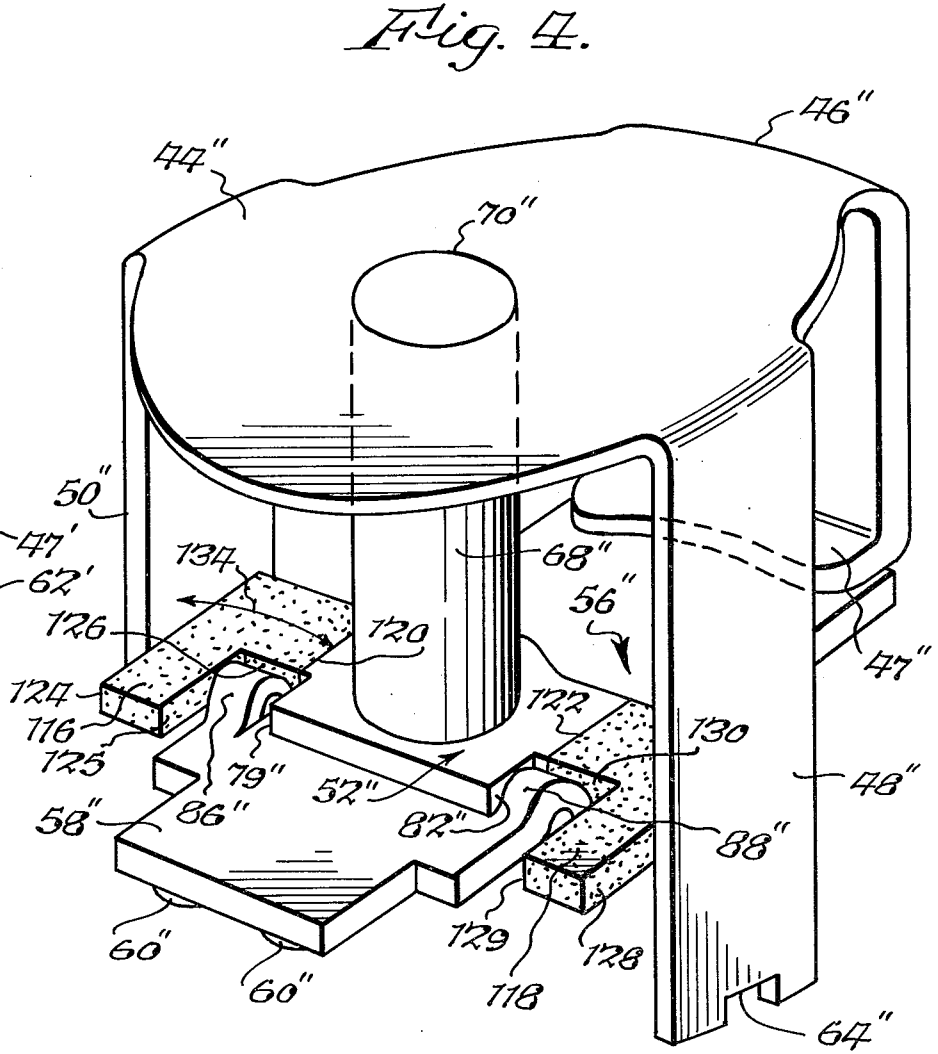
FIG. 4 is a perspective view of a magnetic frame and armature assembly providing an improved magnetic circuit according to another embodiment of the present invention.

FIG. 4 illustrates a magnetic frame according to another embodiment of the present invention. In FIG. 4 components identical to those shown in FIG. 2 are identified by similar reference numerals having a double prime designation. In the frame shown the core face 52'' is of a bi-metal structure including a center, magnetic portion and two opposite or outer end portions 116,118 of non-magnetic material indicated by the stipling in FIG. 4. In particular, portions 116,118 can be of a non-magnetic stainless steel and the center portion of the core face 52'' is of magnetic iron. Portions 116 and 118 are joined to the center section of the core face 52'' at seams or junctions 120 and 122, respectively. The manner of securement is similar to that of the legs to the frame end illustrated in FIG. 3 and will be described in detail presently. In the structure shown, the non-magnetic portions 116 and 118 extend from outer end surfaces 124 and 128, respectively, inwardly to a location just short of the inner edges 79'' and 82'', respectively, of the recesses. In particular, the recess which receives armature projection 86'' is defined by edges 125 and 126 of non-magnetic portion 116 of the core face and by edge 79'' of the magnetic portion. Similarly the recess which receives armature projection 88'' is defined by edges 129 and 130 of the non-magnetic portion and by edge 82'' of the magnetic portion of the core face. Each of the non-magnetic portions 116,118 provides a barrier which increases the reluctance of the fringing flux paths, for example paths 92,94 shown in FIG. 2 thereby increasing the relay efficiency. The length of the air gap which the fringe flux must traverse is greatly increased, extending for example from seam 120 on core face 52'' to the inner surface of leg 50'' and being identified by line 134 in FIG. 4. A similar increased air gap extends between seam 122 and the inner surface of leg 48''.

With the core face portions 116,118 being of non-magnetic material, the magnetic flux is directed along the useful flux path, for example path 90 shown in FIG. 2, to the frame pad 47'' and adjacent air gap where useful work is being done thereby making the relay more efficient. The non-magnetic sections 116,118 cannot be extended too far inwardly toward core 68'' because this would interfere with the useful flux path extending along the armature 56'' through the center portion of core face 52'' to the core 68''. The structure shown in FIG. 4 includes a bi-metal core face 52'' in combination with frame legs 48'', 50'' of magnetic material. Alternatively, the legs 48'', 50'' could be entirely of non-magnetic material such as stainless steel or could have a major portion thereof of such non-magnetic material thereby increasing further the reluctance of the fringing flux path and thereby further increasing the efficiency of the relay.

From the foregoing description it is apparent that an improved magnetic circuit for miniature relays has been provided. The relay efficiency is increased by providing a barrier in the fringing flux path of a material causing the fringing flux path to have sufficient reluctance to resist the flow of flux therethrough. As a result there is an increase in the flow of flux through the useful flux path providing a significant increase in motor torque and consequent increase in relay efficiency. By way of example, a structure of the type shown in FIG. 3 but with only about half of each of the frame legs being of non-magnetic material, in particular the non-magnetic leg portions being #302 stainless steel and the remainder of the legs and frame being magnetic Armco iron, was tested at a constant power input to the relay coil of 60 milliwatts. Measured motor torque increased about 10% throughout armature travel as compared to magnetic frame structures of the type shown in FIG. 2 tested under similar conditions. Increasing the non-magnetic portions of the frame legs to the point where they are entirely non-magnetic as in the structure of FIG. 3 will result in an even greater percentage increase in motor torque.

Another advantage observed to result from the increased available torque for the relay motor is simplification of the alignment and positioning of the fixed and movable contacts mounted on the relay header. Difficulties associated with the adjustment of the position of the contacts on the relay header depend to a great extent on the availability of relay motor torque. A weak motor requires precise positioning of the contacts whereas a strong motor eliminates that critical need for precise positioning.

Figure 5:
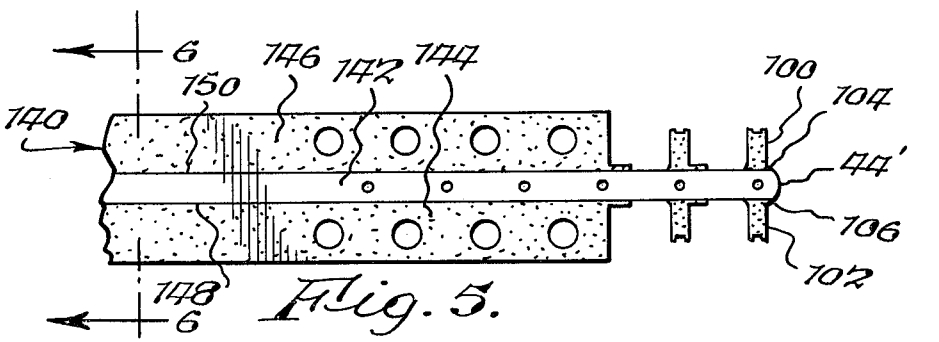
FIG. 5 is an elevational view of a bi-metal structure illustrating various steps of a method according to the present invention for making the frame shown in FIG. 3.
Figure 6:
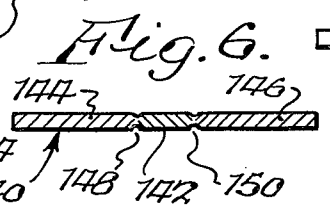
FIG. 6 is a sectional view taken along lines 6—6 of FIG. 5.

FIGS. 5 and 6 illustrate a method of making the bi-metal magnetic frame according to the present invention. FIG. 5 shows a composite metal strip illustrating the various progressive steps in the method of making the frame. The strip 140 is formed by establishing or providing a center magnetic metal strip or portion 142 with two side non-magnetic metal strips or portions 144 and 146.

In particular, the magnetic strips 142 preferably is of iron and positioned between the non-magnetic strips 144,146 in edge-abutting and co-planar relation, the strips 144,146 preferably being of stainless steel. The center strip 142 and the side strips 144,146 are bonded together along the abutting edges, preferably by electron beam welding, to create a composite strip. As a result, in a lateral direction across the finished material there are two strips of non-magnetic material 144 and 146 separated by a strip of magnetic material 142 at the seams 148 and 150, respectively.

Both the magnetic and non-magnetic strip materials should be of the same thickness to generate good welds. The camber and edge conditions of the materials should be controlled, and the materials must be compatible for welding. After the welding operation, the composite strip 140 is shaped to specific flatness. In particular, the composite strip usually is cold rolled to provide a flush straight piece of material stock prior to punching and forming operations. Rolling the material to a specific flatness insures that there are no weld protrusions which might interfere with the operation of a precision die.

Since the resulting formed magnetic frame must be magnetically annealed, the non-magnetic material of the sections 144,146 also must be compatible to the magnetic material of the central portion 142 from an annealing standpoint to the extent that the magnetic properties of the magnetic material are not altered or destroyed, and/or the non-magnetic material does not become brittle or magnetic as a result of magnetic annealing. Shaping the composite strip 140 to provide a flush straight piece of material preferably is performed by a cold rolling operation to obtain the necessary flatness. The amount of cold rolling must not be excessive so that there is no degradation of the magnetic properties of the magnetic section 142. Also, there must be a sufficient amount of cold rolling to generate the flatness required. Accordingly, by controlling the electron beam welding operation, a miniumum amount of cold rolling will be required.

The non-magnetic material portions 144,146 must be of the proper width, so that in the finished product magnetic isolation is provided at the proper location to obtain the benefits of the bi-metal material.

The right hand portion of FIG. 5 shows progressive stages in forming composite strip 140 into a a bi-metal frame such as that shown in FIG. 3 including magnetic and non-magnetic sections of selected configuration and shape. The two sections at the far right-hand end of the strip as viewed in FIG. 5 are the result of several punching and stamping operations. The last section is a frame with two completely non-magnetic supporting legs of the type shown in FIG. 3. In particular, the last section includes the magnetic frame end 44' and the two non-magnetic legs 100,102 which join the magnetic frame end 44' along the seams 104,106, respectively. Additional operations of course have to be performed such as separating the sections, forming the pole piece 46 and frame pad 47 by bending, bending the legs 100,102 to the desired position, and magnetically annealing the resulting bi-metal frame.

By way of example, in an illustrative method, strip 142 is cold drawn Remko B magnetic iron, having a width of about 0.205 inch, each strip 144,146 is non-magnetic stainless steel AISI 304 having a width of 0.395 inch, the maximum camber is ½ inch per eight feet, the thickness of the composite strip is about 0.014 inch and the hardness is 50-65RB.

The method of the present invention can be used in the manufacture of the bi-metal core face 52'' shown in FIG. 4 and also in the manufacture of bi-metal frames of other shapes and configurations for miniature electromagnetic devices.

Figure 7:
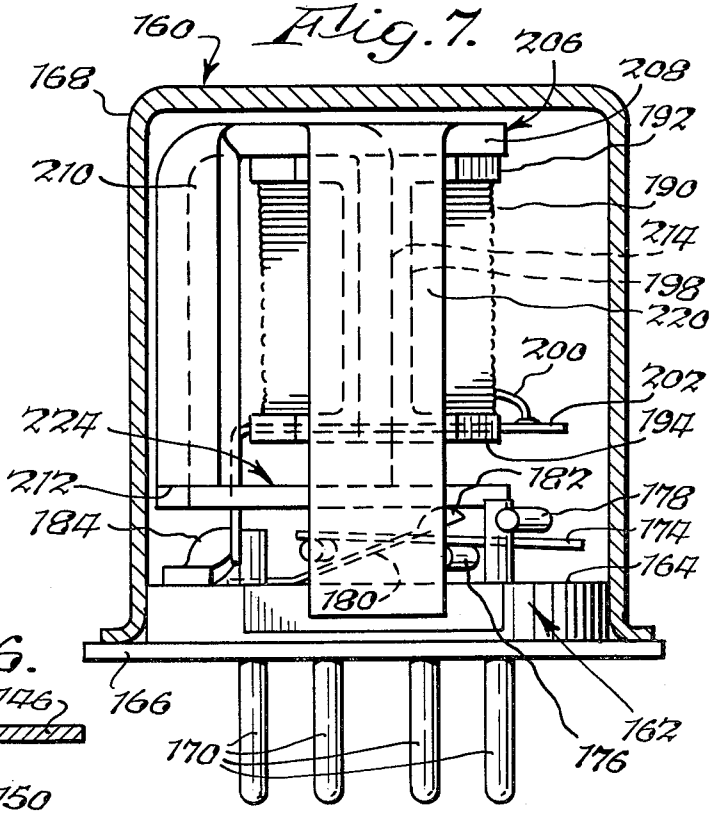
FIG. 7 is an elevational view of another miniature relay.
Figure 8:
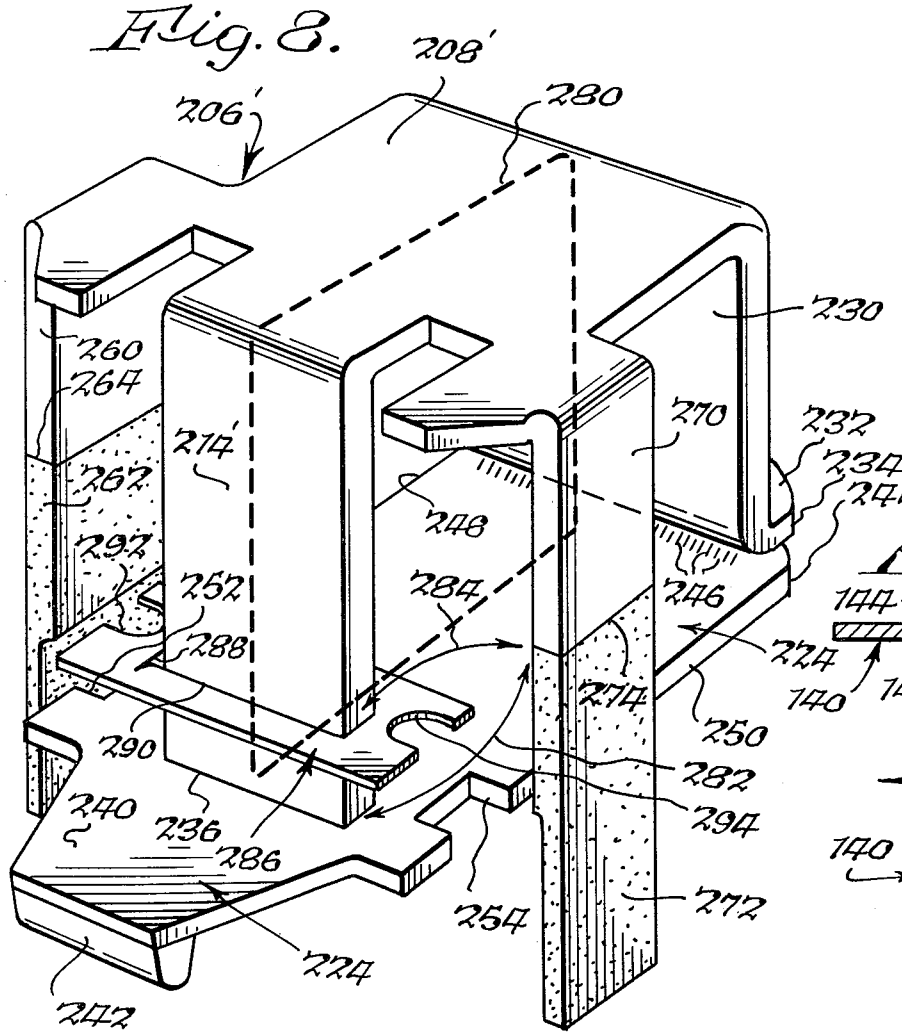
FIG. 8 is a perspective view of a magnetic frame and armature assembly providing an improved magnetic circuit according to another embodiment of the present invention for use in the relay of FIG. 7.

FIGS. 7 and 8 show a miniature relay 160 according to another embodiment of this invention. A metal header generally designated 162 has a platform surface 164 and a peripheral flange 166 to which a casing or cover 168 is hermetically sealed such as by soldering or welding as in the previous embodiments. The header carries a plurality of current-carrying terminal pins 170 which project through apertures in header 162 and are secured by fused glass (not shown). A movable contact member or switch blade 174 in the form of a thin strip of resilent metal is carried by header 162 and electrically coupled such as by being welded at one end to one of the terminal pins. The opposite or free end portion of switch blade 174 is movable between a pair of spaced-apart fixed or stationary contact members 176 and 178 in the form of metal wire segments each electrically coupled to a corresponding one of the terminal pins 170 such as by welding. The foregoing assembly of movable contact 174 and fixed contacts 176,178 is located within one-half of the header surface 164, and a similar assembly of movable contacts and fixed contacts can be located within the other half of the header surface. A biasing means in the form of a metal leaf spring member 180 is supported by header 162 and has an enlargement 182 at the end thereof which operatively engages the relay armature. An adjustable metal stop element 184 is fixed to header surface 164 and establishes the rest or de-energized position of the relay armature.

The relay motor assembly includes a wire coil 190 wound on a bobbin of insulative material which includes spaced-apart end flanges 162 and 164 joined by a core section 198. Coil 190 is positioned in the relay structure with the longitudinal axis of the coil substantially perpendicular to the header surface 164. Current is delivered from one of the terminal pins 170 through a ribbon and a lead to the coil 190 to excite the winding and operate the relay. In the relay shown, a lead 200 from coil 190 is connected to one end of a ribbon 202 which extends through the flange 194 and then downwardly through the relay structure to one of the terminal pins 170.

A magnetic frame 206 includes an end portion 208, a pole portion 210 operatively associated with coil 190 defining a magnetic pole face 212, and a core portion 214 extending axially to the coil opening and beyond the coil. Frame 206 is of ferro-magnetic material and formed with pole portion 210 being of arcuate cross-section and extending in generally orthogonal relation to the end portion 208. Pole portion 210 is of considerable arcuate length, extending along substantially one side of the coil 190, and also is of a dimension measured parallel to the axis of coil 190 such that the frame end portion 208 is adjacent one axial end of coil 190 and pole face 212 is located axially beyond the opposite end of coil 190. Core portion 214 is of rectangular cross section and also extends in generally orthogonal relation to the frame end portion 208 and terminates in an end surface beyond the coil. Frame 206 also includes a pair of spaced, depending parallel legs, one of which is shown at 220 at FIG. 7, which legs extend at right angles to the frame end portion 206 in the same direction as the pole 210 and core 214. The legs are of sufficient length to reach corresponding flat surface portions on the periphery of the header 162 for securement thereto such as by soldering or welding.

An armature 224 is located in spaced relation to header 162 and is in the form of a generally planar, plate-like body of ferromagnetic material having a first portion or end tab at the right hand end as viewed in FIG. 7 provided with an operator element of insulative material (not shown in FIG. 7) fixed to the lower surface of the tab and of sufficient length for operatively engaging both of the movable switch blade elements. The opposite end of the armature 224 has a smooth, continuously curved or arcuate edge, and surface 212 of the pole piece end portion 210 has substantially the same curvature as the armature edge. The position of armature 224 is shown in FIG. 7 in the energized condition of the relay. When the relay is deenergized, the portion of the armature 224 adjacent the pole face 212 is spaced a small distance from the pole piece end portion to define an air gap.

Referring now to FIG. 8, there is shown a magnetic frame according to the present invention for use in a relay of the type shown in FIG. 7. Parts in the arrangement of FIG. 8 similar to those of FIG. 7 are provided with identical reference numerals having a prime designation. The frame 206′ shown in FIG. 3 has a generally planar end portion 208′ and a pole piece operatively associated with the coil and comprising a main body portion 230 and an end portion 232 which terminates in an arcuate end face 234. The pole piece shown in FIG. 8 differs from that of FIG. 7 in that portion 230 is generally planar and portion 232 extends outwardly from portion 230 at about a right angle thereto. The core portion 214′ extends axially through the opening in the coil and beyond the coil where it terminates in a planar end face 236. Frame 206′ is of ferromagnetic material and formed with the pole piece main body portion 230 being generally planar and extending in generally orthogonal relation to the end portion 208′. The pole piece main body portion 230 is of considerable width extending along substantially one side of the relay coil, and it also is of a length measured parallel to the axis of the relay coil such that the frame end 208′ is adjacent one axial end of the coil and the pole piece end portion 232 is located axially beyond the opposite end of the coil. The core 214′ is of rectangular cross-section and also extends in generally orthogonal relation to the end portion 208′ and terminates in the end surface 236 which is located beyond the coil. The end surface 236 is rectangular and disposed in a plane generally perpendicular to the axis of the relay coil. The frame 206′ is formed by metal stamping and forming techniques facilitated by provision of notches adjacent the bend between end portion 208′ and core portion 214′.

The armature 224 is a generally planar, plate-like body of ferromagnetic material having a first portion or end tab 240 provided with an operator element 242 of insulative material fixed to a lower surface of tab 240 and of sufficient length for operatively engaging the movable switch blade elements. The opposite end of armature 224 has a smooth, continuous curved or arcuate edge 244, and surface 234 of pole piece end portion 232 has substantially the same curvature as the edge 244. When the relay is deenergized, the portion of armature 224 adjacent edge 244 is spaced a small distance from the pole piece end portion 232 to define an airgap designated 246 in FIG. 8.

The armature 224 has substantially parallel opposite side edges 248,250 joining the opposite ends thereof, and first and second rectangular shape recesses or slots 252 and 254 extend inwardly from the edges 248 and 250, respectively. The two slots are substantially perpendicular to the corresponding side edges, are aligned, and the inner end surfaces or edges of the slots are substantially parallel and define therebetween an armature recessed area or portion of reduced lateral dimension. A pair of armature holding elements (not shown) generally in the form of posts extend in spaced-apart relation from the electromagnetic assembly, in particular from the end flange of the coil bobbin. The distance between the inner end surfaces of the armature notches 252 and 254 allows the region of the armature therebetween to be received in the elongated open region between the two depending holding elements or posts such that the latter provide a saddle-like region for the armature portion. The armature 224 is continually urged into that saddle by the action of the leaf spring 180. The foregoing arrangement provides limited angular movement of the armature 224 about or relative to the region between the depending posts along a plane which is substantially parallel to the longitudinal axis of the coil. For a more detailed description of the structure and operation of the relay shown in FIGS. 7 and 8, reference may be made to U.S. Pat. No. 4,101,855 issued July 18, 1978, the disclosure of which is hereby incorporated by reference.

Magnetic frame 206′ is a bi-metal construction and this is included in the pair of spaced, parallel legs which extend at substantially right angles to the frame end portion 208′. In particular, one of the legs includes a first portion 260 extending from the edge of frame end 208′ and of the same ferromagnetic material as portion 208′. Portion 260 is joined to a leg portion 262 of non-magnetic material, for example non-magnetic stainless steel, along a seam or juncture 264. The non-magnetic portion 262 extends for a major portion of the overall length of the leg. In addition, the lower portion end portion of the leg section 262 is of reduced thickness as shown in FIG. 8. Similarly, the other leg includes a first portion 270 of the same ferromagnetic material as frame end portion 208′ and extends at right angles thereto. The portion 270 is joined to another portion 272 of non-magnetic material, for example non-magnetic stainless steel, along a seam or juncture 274. Section 272 likewise occupies a major portion of the length of the leg and the lower end portion thereof is of reduced thickness like that of section 262. In addition, the two non-magnetic sections 262, 272 are of substantially the same length. The bi-metal frame of FIG. 8 can be manufactured by the foregoing method described hereinabove.

The main flux path or useful flux path is designated 280 in FIG. 8. The bi-metal frame having non-magnetic leg sections 262,272 includes a barrier which increases the length of the air gap which the fringing magnetic flux must traverse. Such increased air gaps are designated 282 and 284, for example, in FIG. 8. Similar increased air gaps exist between leg portion 260 and the lower end of core 214′ as viewed in FIG. 8. In addition, these air gaps can be increased even further by having both legs entirely of non-magnetic material similar to legs 100,102 in the embodiment of FIG. 3. The provision of the barrier enables a simpler construction by the use of a simple core retainer element 286 in place of prior coil supports of non-magnetic material which can be difficult to install. The retainer 286 is simply a thin sheet or plate of metal, rectangular in shape, having a rectangular opening 288 cutout therein to receive the core portion 214. The rectangular cutout is formed with an offset tab 290 thereby providing a friction fit with the core 214. The retainer 286 is fitted on core 214′ adjacent the lower flange of the electromagnetic coil. The opposite ends of the retainer 286 are provided with cutout recesses 292,294 through which the aforementioned post elements extend to be received in the recesses 252,254 of the armature. The retainer 286 thus is carried by the core 214′ adjacent the lower end thereof for holding the coil in place on the core 214′. During assembly of the relay, the coil is fitted onto the core 214′ of frame 206′ and retainer 286 is fitted on the core 214′ next to the end of the coil to hold it in place on the core 214′. The frame 206′ with coil held thereon comprises a subassembly which easily is manipulated for positioning and assembly to complete the relay.

As will be apparent to persons skilled in the art, various modifications and adaptations of the structure and method above described will become readily apparent without departure from the spirit and scope of the invention the scope of which is defined in the appended claims.

I claim:

1. An improved magnetic circuit for a miniature relay comprising a coil carried by a magnetic frame having a core portion terminating in a core face and a pole piece portion terminating in a pole face, and an armature having a portion spaced a small distance from said pole face defining an air gap therebetween when said coil is deenergized, said armature adapted for movement in response to energization of said coil to close said air gap, said armature having a portion adjacent said core face thereby defining a useful, desired flux path through said core portion, said pole piece portion, said air gap between said pole face and said armature, said armature and said core face, said frame having another portion located sufficiently close to said core face to define a fringing, undesired flux path through said other frame portion and core face tending to divert flux from said useful flux path, and a barrier in said fringing flux path of a material causing said fringing flux path to have sufficient reluctance to resist the flow of flux therethrough.

2. The magnetic circuit recited in claim 1, wherein said barrier is located in said other portion of said frame.

3. The magnetic circuit recited in claim 1, wherein said barrier is located in said core face and spaced from said useful flux path.

4. The magnetic circuit recited in claim 1, wherein said barrier is located in said other portion of said frame and in said core face spaced from said useful flux path.

5. The magnetic circuit recited in claims 2, 3 or 4 wherein said barrier is of non-magnetic material.

6. The magnetic circuit recited in claims 2, 3 or 4 wherein said frame is of iron and said barrier is of stainless steel.

7. The magnetic circuit recited in claim 1, wherein said other portion of said frame comprises a pair of spaced-apart leg members extending therefrom in straddling relation to said coil, each of said leg members being of non-magnetic material along a major portion of the length thereof to provide said barrier.

8. The magnetic circuit recited in claim 7, wherein each of said leg members is of non-magnetic material along the entire length thereof.

9. The magnetic circuit recited in claims 7 or 8 wherein said frame is of iron and said non-magnetic material is stainless steel.

10. The magnetic circuit recited in claim 1, wherein said other portion of said frame comprises a pair of spaced-apart leg members extending therefrom in straddling relation to said coil, each of said leg members being of non-magnetic material along a major portion of the length thereof to provide said barrier, and wherein said core face is in the form of a plate disposed substantially at right angles to said legs and having opposite ends each spaced a short distance from a corresponding one of said legs defining air gaps therebetween.

11. The magnetic circuit recited in claim 10, wherein each of said leg members is of non-magnetic material along the entire length thereof.

12. The magnetic circuit recited in claims 10 or 11 further including non-magnetic material in said core face adjacent the opposite ends thereof and spaced from the useful flux path through said core face.

13. A mounting for supporting an electromagnet in a miniature relay, said electromagnet comprising a coil within a magnetic frame having an end portion, a core portion extending from said end portion through said coil terminating in an end face beyond said coil, and spaced-apart leg members extending from said frame end portion, a supporting base, said leg member being fixed to said supporting base, a coil retainer element carried by said frame core portion near said end face for holding said coil on said core, and a major portion of each of said leg members being of non-magnetic material.

14. The mounting recited in claim 13, wherein each of said leg members is of non-magnetic material along the entire length thereof.

15. The mounting recited in claim 13, wherein said coil retainer element is of metal.

16. The mounting recited in claim 13, wherein said frame is of iron and said non-magnetic material is stainless steel.

* * * * *